United States Patent [19]

Brown

[11] Patent Number: 4,924,788

[45] Date of Patent: May 15, 1990

[54] HOOK TIMING ARRANGEMENT FOR ZIG ZAG SEWING MACHINES

[75] Inventor: Jerry D. Brown, Troy, N.C.

[73] Assignee: Capel Incorporated, Troy, N.C.

[21] Appl. No.: 327,318

[22] Filed: Mar. 22, 1989

[51] Int. Cl.[5] ..... D05B 3/02; D05B 57/00

[52] U.S. Cl. ..... 112/182; 112/190

[58] Field of Search ..... 112/182, 467, 190

[56] References Cited

U.S. PATENT DOCUMENTS

| | | | |
|---|---|---|---|
| 1,159,523 | 11/1915 | Miller . | |
| 2,690,723 | 10/1954 | Sudo . | |
| 2,932,268 | 4/1960 | Johnson . | |
| 3,490,401 | 1/1970 | Hamlett . | |
| 3,779,187 | 12/1973 | Adams . | |
| 3,783,810 | 1/1974 | Marforio . | |
| 3,804,042 | 4/1974 | Ross . | |
| 4,357,887 | 11/1982 | Hara et al. | 112/467 X |
| 4,662,292 | 5/1987 | Koike et al. | 112/467 X |
| 4,674,423 | 6/1987 | Koike et al. | 112/467 X |

*Primary Examiner*—Andrew M. Falik

*Attorney, Agent, or Firm*—Shefte, Pinckney & Sawyer

[57] ABSTRACT

In a zig-zag sewing machine wherein a sewing needle is shifted laterally with respect to a hook rotated about a fixed axis, the hook is optimally timed with respect to the needle at each shifted stitch position of the needle by accelerating rotation of the hook to advance it into optimal disposition relative to the needle at one stitch position of the needle and decelerating rotation of the hook to retard it into equally optimal disposition relative to the needle at the other stitch position of the needle.

12 Claims, 6 Drawing Sheets

HOOK TIMING ARRANGEMENT FOR ZIG ZAG SEWING MACHINES

BACKGROUND OF THE INVENTION

The present invention relates generally to sewing machines of the type wherein the thread-carrying needle is laterally shifted to form sewn stitches in a zig-zag pattern and, more particularly, relates to a mechanism for timing rotation of the cooperating hook in synchronism with the lateral shifting movements of the needle.

Sewing machines capable of forming an ornamental chain of lock stitches in a laterally-shifting, so-called zig-zag pattern are well known and in widespread commercial use. In a typical commercial zig-zag sewing machine, the thread-carrying needle is driven from a main drive shaft of the machine through intermediary eccentric cam mechanisms to reciprocate lengthwise upwardly and downwardly through a throat plate in a stitching bed in the machine frame while the needle is laterally shifted leftwardly and rightwardly in alteration in timed relation to the lengthwise reciprocatory movements of the needle. A looptaker element having a peripheral hooked beak portion, commonly referred to as a hook, is rotatably driven beneath the throat plate in parallel relation to the lateral shifting movements of the needle by a secondary drive shaft driven from the main shaft in timed relation to the needle reciprocating and shifting movements. A thread-carrying bobbin is mounted stationarily alongside the looptaker. In operation, upon the completion of each downward stroke of the needle, a loop of the thread carried by the needle is formed as the needle begins its upward stroke, the timing of the rotation of the looptaker in relation to the needle being such that the hook of the looptaker seizes the loop and carries it around the bobbin to lock stitch the threads of the needle and bobbin together.

A long-standing and widely recognized problem in the operation of zig-zag sewing machines of the aforementioned type is that, since the looptaker is conventionally rotated at a constant speed about a fixed axis, the looptaker cannot be timed with respect to the needle to present the hook in an optimal disposition with respect to the needle at both of the laterally shifted leftward and rightward positions of the needle. Accordingly, it is conventional practice to coordinate the rotation of the looptaker with respect to the needle reciprocation as though the needle were being reciprocated in a non-shifting straight stitch position equidistant the leftward and rightward shifted needle positions for the zig-zag stitch. In this manner, the hook is equally out of optimal timed relationship with the needle at each of the needle's leftwardly and rightwardly shifted positions, whereby the hook prematurely takes the thread loop when the needle is shifted rightwardly in the direction towards the approaching hook and likewise is delayed in taking the loop when the needle is shifted leftwardly in the opposite direction away from the approaching hook. While the sewing machine is acceptably operable with this manner of timing of the rotating hook with respect to the reciprocating and shifting needle, missed stitches, broken needles and prematurely worn hooks still inevitably occur.

Various proposals have been made to regulate the depth of needle penetration through the throat plate with respect to the hook to compensate for the shifted dispositions of the needle to improve the timing of the needle with respect to the hook, as representatively disclosed in U.S. Pat. Nos. 1,159,523; 2,932,268; and 3,779,187. However, none of these arrangements are known to have met with any significant degree of commercial acceptance and success. In other types of zig-zag sewing machines, the looptaker or other looper device is arranged for lateral shifting in timed relation to the lateral shifting of the needle to achieve proper relative timing, as representatively disclosed in U.S. Pat. Nos. 2,690,723; 3,490,401; and 3,783,810. It is also known in another type of zig-zag sewing machine to provide a cam-controlled mechanism for intentionally producing a pattern of missed stitches by selectively advancing or retarding rotation of the looptaker out of timed relationship with respect to the needle, as disclosed in U.S. Pat. No. 3,804,042.

SUMMARY OF THE INVENTION

It is accordingly an object of the present invention to provide a simple and reliable mechanism for use in a zig-zag sewing machine of the above-describe type to drive rotation of the looptaker in timed relation to shifting movements of the needle to position the hook of the looptaker in optimal relationship to the needle at each shifted position thereof.

The present invention is basically adapted for incorporation in essentially any zig-zag sewing machine a thread-carrying needle, a needle manipulating mechanism for reciprocating the needle longitudinally to form thread loops and for shifting the needle laterally between spaced first and second loop-forming positions to distribute the thread loops in a zig-zag pattern, a looptaker rotatable about a fixed axis and having a hook for cooperating with the needle to seize the thread loops, and a mechanism for rotating the looptaker.

Briefly summarized, the present invention provides an improved arrangement for coupling the looptaker mechanism to the needle manipulating mechanism for alternately accelerating and decelerating rotation of the looptaker in timed relation to the lateral shifting movement of the needle between its first and second loop-forming forming positions. In this manner, the hook of the looptaker is advanced into a first loop-seizing disposition in relation to the needle at its first loop-forming position and, likewise, the hook of the looptaker is retarded into a second loop-seizing disposition in relation to the needle at its second loop-forming position.

As in a conventional zig-zag sewing machine, the needle manipulating mechanism includes a main drive shaft while the looptaker rotating mechanism includes a secondary drive shaft. The coupling arrangement of the present invention includes a drive train for transmitting motion of the main drive shaft to the secondary drive shaft with the drive train including first and second drive members. The first drive member is arranged in driven relationship with the main drive shaft, while the second drive member is arranged in driven relationship to the first drive member and in driving relationship with the secondary drive shaft. A transmission mechanism provides for reciprocal shifting movement of the second drive member with respect to the first drive member in synchronism with the lateral shifting of the needle for varying the drive transmission from the second drive member to the secondary drive shaft.

As is also conventional, the needle manipulating mechanism of the sewing machine includes a mechanism for driving a reciprocable rod connected with the needle for laterally shifting the needle between its first and second loop-forming positions. In two possible embodiments of the present invention, the first drive member is rotatable with respect to the secondary drive shaft to the looptaker and the second drive member is fixed with respect to the secondary drive shaft, the transmission arrangement including a drive link connected to the reciprocable rod of the needle shifting mechanism and arranged in association with the second drive member for rotationally reciprocating the second drive member and the secondary shaft with respect to the first drive member in synchronism with the reciprocable rod.

In one such embodiment, the first drive member includes a driving bevel gear and the second drive member includes a driven gear meshing with the driving bevel gear, the transmission arrangement including a gear mechanism associated with the driven bevel gear and the drive link for shifting the relative meshing disposition of the driven bevel gear with respect to the driving bevel gear.

In the other embodiment, the first drive member is a driving pulley while the second drive member is a drive pin fixed to the secondary shaft to the looptaker. The transmission arrangement includes a cam fixed to the driving pulley and associated with the drive pin for shifting the relative rotational disposition of the shaft with respect to the driving pulley and the cam.

In a third possible embodiment of the present invention, the first drive member is fixed with respect to the main drive shaft of the needle manipulating mechanism and the second drive member is rotatably disposed coaxially about the first drive member. The transmission arrangement includes a planetary gear arranged to orbit about the axis of the main shaft and to rotate within its orbit in timed relation to the lateral shifting movement of the needle. A connecting link is connected eccentrically to the planetary gear and is connected to the second drive member for rotationally reciprocating the relative rotational disposition of the second drive member with respect to the main shaft and the first drive member.

DESCRIPTION OF THE PREFERRED EMBODIMENT

Figure 1:
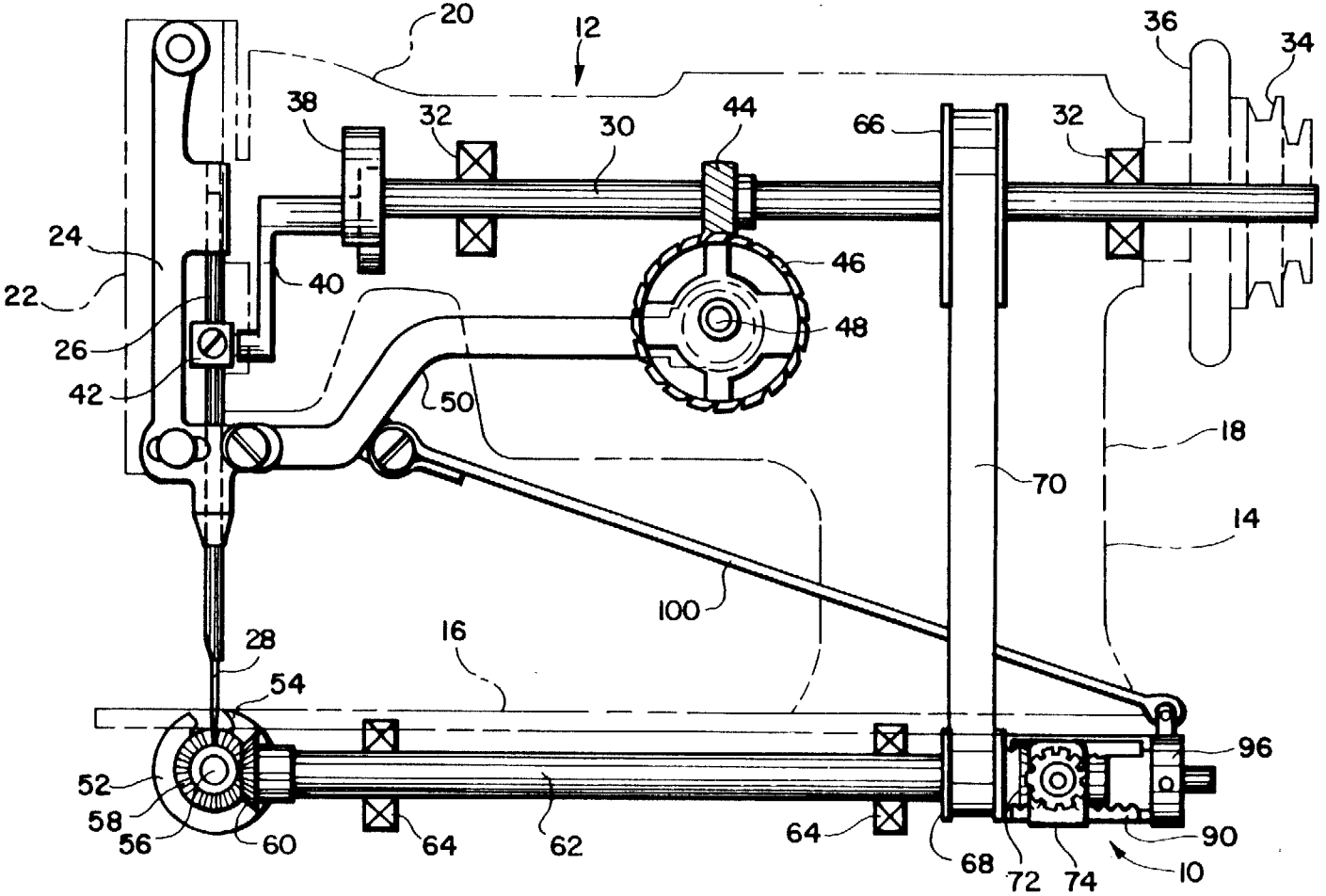
FIG. 1 is a front elevational view of the mechanical working components of a conventional zig-zag sewing machine, the frame of which is shown in phantom lines, incorporating one preferred embodiment of the hook timing arrangement of the present invention.

Referring now to the accompanying drawings and initially to FIG. 1, a first embodiment of the hook timing arrangement of the present invention is indicated generally at 10 as preferably embodied in an otherwise conventional sewing machine of the zig-zag lock stitch type, indicated generally at 12. By way of example and without limitation, the illustrated zig-zag sewing machine is representative of the SINGER brand sewing machine Model No. 107W3 manufactured by The Singer Company of New York, N.Y., or the YAMATO brand machine Model No. DP3 manufactured by Yamato Sewing Machine Manufacturing Co. Ltd. of Japan. Of course, as those persons skilled in the art will recognize, the present invention may be equally well adapted for use in other types of zig-zag sewing machines. Inasmuch as the construction and operation of the SINGER and YAMATO machines are well known within the art, the sewing machine 12 is illustrated and described herein only to the extent necessary to facilitate an enabling disclosure of the present invention.

As seen in FIG. 1, the sewing machine 12 has a substantially hollow structural frame 14, shown only in phantom, which includes a horizontal machine bed 16, an upstanding arm 18 extending from the rightward end of the bed 16, and a horizontal arm 20 extending from the upright arm 18 and terminating in a sewing head 22 spaced directly above the bed 16. A needle bar frame 24 is pivotably supported within the sewing head 22 for relative swinging movement leftwardly and rightwardly, as viewed in FIG. 1, and a needle bar 26 having a sewing needle 28 affixed to its depending end is slidably supported by the needle bar frame 24 for longitudinal movement relative thereto.

A main drive shaft 30 is rotatably supported by bearings 32 to extend horizontally through the hollow horizontal arm 20 of the machine frame 14. The rightward end of the drive shaft 30 extends outwardly from the frame 14 and has a drive pulley arrangement 34 fixed to the exposed end of the drive shaft 30 to facilitate driven operation thereof from any suitable power source. A hand wheel 36 is also fixed to the exposed extent of the drive shaft 30 for manually operation thereof. The opposite end of the drive shaft 30 carries a counterweight 38, one end of a crank arm 40 being pivotably mounted eccentrically to the counterweight 38 with its opposite end being affixed by a connecting bracket 42 to the needle bar 26 for reciprocating the needle bar 26 longitudinally upwardly and downwardly with respect to the needle bar frame 24. A spiral pinion gear 44 is affixed to the main drive shaft 30 at an intermediate location in meshing engagement with another spiral gear 46 mounted on a perpendicular shaft 48 supported by the machine frame 14 immediately below the pinion gear 44. A drive rod 50 is mounted eccentrically at one end to the spiral gear 46 and is connected at the opposite end to the needle bar frame 24 to drive reciprocating leftward and rightward swinging movement of the needle bar frame 24 (as viewed in FIG. 1). In this manner the drive shaft 30 controls vertical reciprocating movement and lateral shifting movement of the needle 28 for stitch formation, in a conventional fashion.

The bed 16 of the machine frame 14 includes a throat plate (not shown) immediately beneath the assembly of the needle bar frame 24 and the needle bar 26 to define a stitching work area through which the needle 28 is permitted to penetrate the bed 16. Immediately beneath the throat plate, a looptaker 52 having a beaked hook portion 54 at its outer periphery, such unit sometimes being commonly referred to in its entirety as a hook, is fixed to a shaft 56 rotatably supported by the bed 16 for rotational movement of the looptaker 52 in cooperation with the reciprocating needle 28, as is conventional. A bevel gear 58 is mounted coaxially on the shaft 56 in meshing engagement with another bevel gear 60 mounted at the leftward end of a secondary drive shaft 62 rotatably supported by bearings 64 horizontally along the underside of the bed 16.

Figure 3A:
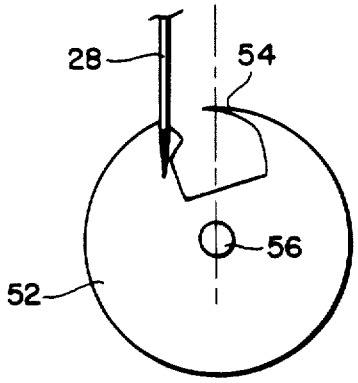
FIG. 3A PRIOR ART
FIGS. 3A and 3B are relatively enlarged side elevational views representatively showing the relative dispositions of the needle and rotating hook in the sewing machine of FIG. 1 at the leftwardly and rightwardly shifted loop-forming positions of the needle as timed according to conventional prior art practice.
Figure 3B:
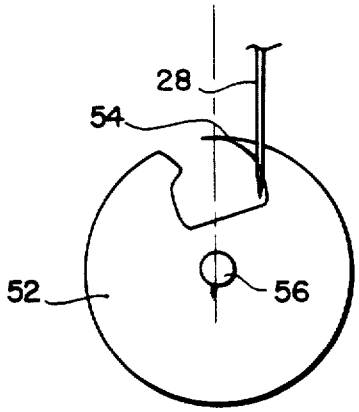
FIG. 3B PRIOR ART

Conventionally, the secondary drive shaft 62 is belt-driven from the main drive shaft 30 in timed relation therewith via appropriate speed-change pulleys fixed respectively to the main and secondary drive shafts 30, 62, whereby the secondary driven shaft 62 and, in turn, the looptaker 52 are driven at a constant rotation speed. As is conventional, the drive train for the looptaker 52 is provided with appropriate gearing to drive rotation of the looptaker 52 to perform two full revolutions for each downward stitching reciprocation of the needle 28 to lock-stitch each loop of the needle-carried thread with respect to the bobbin-carried thread in a known manner. As aforementioned, however, timing problems arise with this arrangement because the later shifting movements of the needle 238 cause the needle to be alternately disposed upon completing its downward reciprocation at spaced loop-forming stitch positions at opposite lateral sides of the rotational axis of the looptaker 52, while in contrast the hook 54 of the looptaker 52 is at the same angular disposition in its path of rotational movement when the needle 28 is at each of its loop-forming stitch positions because the looptaker 52 is rotated at a constant speed about a fixed axis defined by the shaft 56. This inherent mistiming of the hook 54 and the needle 28 is illustrated in FIG. 3A and 3B, wherein only the needle 28 and the looptaker 52 are shown from the same front elevation as in FIG. 1. In FIG. 3A, the needle 28 is illustrated at its leftwardly shifted loop-forming stitch position, while in FIG. 3B the needle 28 is shown in its rightwardly shifted loop-forming stitch position. In each case, the looptaker 52 is at the identical rotational disposition with its hook 54 passing through the uppermost extent of its counter-clockwise rotational path of movement immediately beneath the throat plate (not shown). Thus, in the leftwardly shifted stitch position of the needle 28, the needle 28 has been shifted generally in the same direction at the counterclockwise rotational path of the hook 54 and, therefore, the hook 54 is delayed in reaching a loop-seizing disposition passing the needle 28, as seen in FIG. 3A. Similarly, as seen in FIG. 3B, at the rightwardly shifted stitch position of the needle 28, the needle 28 has been shifted in a direction essentially opposite the rotational path of the hook 54 and, therefore, the hook 54 passes prematurely through a loop-seizing position adjacent the needle 28. Conventionally, as also aforementioned, the looptaker 52 is timed with respect to the needle 28 to orient the hook 54 in proper loop seizing disposition with respect to an imaginary "neutral" reciprocating path which the needle 28 would follow if its were not shifted laterally, shown in phantom lines in each of FIG. 3A and 3B, which causes the needle 28 and the hook 54 to be equally out of time at each stitch position of the needle. So long as the extent of lateral shifting movement of the needle 28 is not too great, the sewing machine will still perform a zig-zag lock stitching operation, but the mistiming between the needle 28 and the hook 54 produces an undesirable amount of contact between these components causing premature wear and frequent needle breakage and additionally causes a greater than desirable frequency of missed stitches, i.e. wherein the hook 54 of the looptaker 52 fails to properly seize the loop formed by the needle 28.

In contrast, the hook timing arrangement 10 of the present invention provides a drive connection between the main drive shaft 30 and the secondary drive shaft 62 by which the secondary drive shaft 62 and, in turn, the looptaker 52 are accelerated when the needle 28 is shifted to its leftward loop-forming stitch position so as to advance the hook 54 of the looptaker 52 into a loop-seizing disposition in optimal relation with respect to the needle 28 and decelerated when the needle 28 is in its rightward loop-forming stitch position to retard the hook 54 of the looptaker 52 into a loop-seizing disposition also optimally related with respect to the needle 28. As best seen in FIG. 1, a drive pulley 66 is fixed to the main drive shaft 30 and a speed-change drive pulley 68 is rotatably mounted on the secondary drive shaft 62, with a drive belt 70 being trained about the pulleys 66, 68. Except for the rotational rather than fixed manner of mounting of the drive pulley 68 with respect to the secondary drive shaft 62, the drive pulleys 66, 68 are identical to the drive pulleys utilized in a conventional sewing machine as described above and, particularly, are sized to accomplish the aforementioned speed change to produce two revolutions of the looptaker 52 for every stitch-forming reciprocation of the needle 28.

Figure 2:
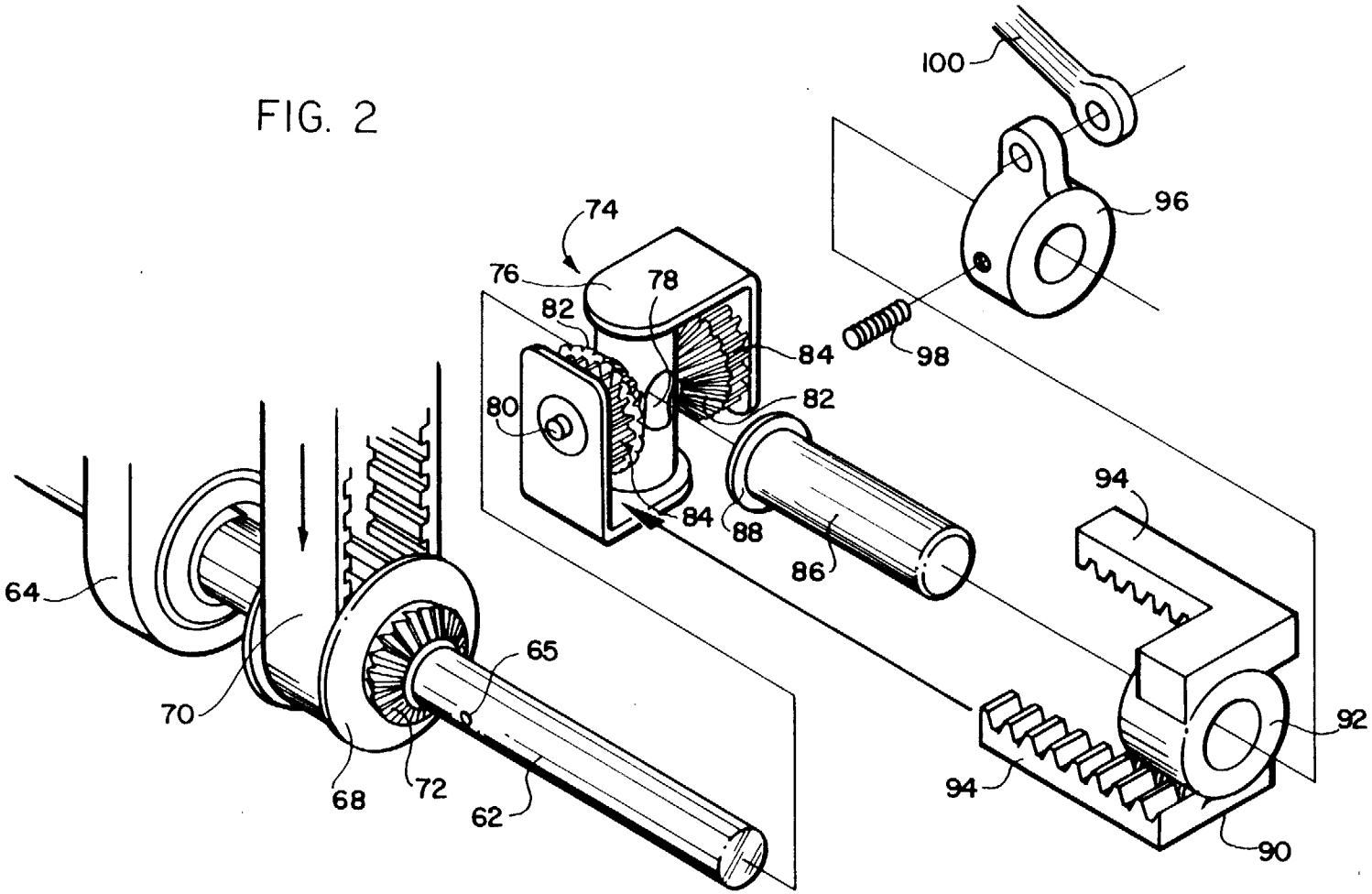
FIG. 2 is an exploded perspective view of the hook timing arrangement of FIG. 1.

As best seen in FIG. 2, a bevel gear 72 is fixed coaxially to one end face of the drive pulley 68 and meshes with a gear assembly 74 fixed to the secondary drive shaft 62 immediately adjacent the drive pulley 68. The gear assembly 74 includes a generally S-shape mounting frame 76 having a central opening 78 by which the frame 76 is mounted on the secondary drive shaft 62. A mounting pin 80 extends through the mounting frame 76 and through the secondary drive shaft 62 at 65 to five the gear assembly 74 thereto, the mounting pin 80 also rotatably supporting a pair of bevel gears 82 and a pair of sprocket gears 84 at opposite sides of the mounting frame 76. Each bevel gear 82 is fixed coaxially to an associated one of the sprocket gears 84 for unitary rotation, the bevel gears 82 being arranged to mesh at essentially diametrically opposite locations with the bevel gear 72. A bushing 86 is mounting on the secondary drive shaft 62 immediately adjacent the gear assembly 74 for free rotation of the shaft 62 within the bushing 86, the bushing 86 including an end flange 88 at its end adjacent the gear assembly 74. A rack assembly 90 is rotatably supported on the bushing 86 by a central hub 92 which abuts the bushing flange 88, the rack assembly 90 having toothed rack arms 94 extending from opposite sides of the hub 92 into respective meshing engagement with the sprocket gears 84 of the gear assembly 74. A bearing 96 is also supported about the bushing 86 and is fixed with respect thereto by a set screw 98. A drive link 100 extends between, and is pivotably connected by eyelets at its opposite ends to, the needle shifting drive rod 50 (see FIG. 1) and the bearing 96, whereby the needle-shifting reciprocations of the drive rod 50 are synchronously transmitted through the drive link 100 to the bearing 96.

Figure 4A:
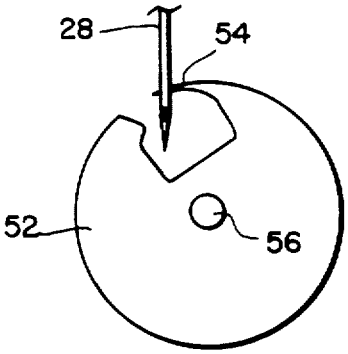
FIGS. 4A and 4B are corresponding side elevational views of the needle and hook showing their relative dispositions at the leftward and rightward loop-forming needle positions are controlled by the hook timing arrangement of the present invention.
Figure 4B:
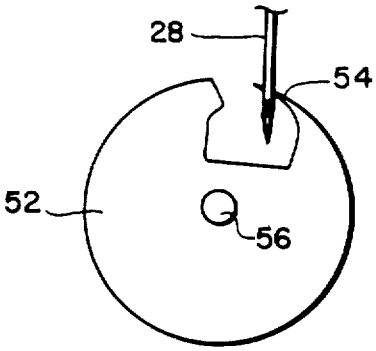

The operation of the hook timing arrangement 10 may thus be understood. Driven rotation of the drive pulley 68 from the drive pulley 66 through the drive belt 70 is transmitted by the bevel gear 72 to the meshing bevel gears 82 of the gear assembly 74. Since the rack arms 94 of the rack assembly 90 mesh with the sprocket gears 84 which are fixed coaxially with the bevel gears 82, the bevel gears 82 are not rotated by the bevel gear 72 but, instead, the entire unit of the gear assembly 74 and the rack assembly 90 and, in in turn, the secondary drive shaft 62 are rotated unitarily by the driving force of the pulley 68 and its bevel gear 72 in a counter-clockwise direction, as viewed in FIG. 2. At the same time, the alternating leftward and rightward shifting movements of the needle 28 actuated by the drive rod 50 are identically transmitted to the bearing 96 through the connecting drive link 100 and, in turn, the assembly of the bearing 96 and its supporting bushing 86 produce linear reciprocation of the rack assembly 90 axially with respect to the secondary drive shaft 62. The reciprocating movements of the rack arms 94 of the rack assembly 90, in turn, produce reciprocatory rotation of the bevel and sprocket gears 82, 84 to alternately reciprocate the gear assembly 74 clockwise and counter-clockwise (as viewed in FIG. 2) with respect to the bevel gear 72 independently of its driven rotation by the drive pulley 68. Thus, when the drive rod 50 reciprocates leftwardly to shift the needle 28 to its leftward stitch position, the rack assembly 90 is similarly shifted in the same direction leftwardly with respect to the secondary drive shaft 62 by the action of the drive link 100 through the bearing 96 to cause the gear assembly 74 to move counter-clockwise with respect to the bevel gear 72 and, in turn, the secondary drive shaft 62 is sufficiently accelerated in relation to the rotational speed which otherwise would be transmitted to the shaft 62 without movement of the rack assembly 90 to correspondingly product accelerated rotation of the looptaker 52 to advance its hook 54 counter-clockwise (as viewed in FIG. 1) into an optimal loop-seizing disposition in relation to the needle 28 at its leftwardly shifted stitch position, as represented in FIG. 4A. Likewise, rightward reciprocation of the drive rod 50 to shift the needle 28 into its rightwardly shifted stitch position causes reciprocation of the rack assembly 90 in the same direction rightwardly with respect to the secondary drive shaft 62, producing clockwise movement of the gear assembly 74 with respect to the bevel gear 72 to sufficiently decelerate the rotation of the secondary drive shaft 62 to correspondingly decelerate the looptaker 52 to retard rotation of its hook 54 to be in an optimal loop-seizing disposition with respect to the needle 28 at its rightwardly shifted stitch position, as represented in FIG. 4B. In comparison to the conventional timing of the looptaker 52 with respect to the needle 28 shown in FIGS. 3A and 3B, it will therefore be readily understood and appreciated that the timing arrangement 10 is operative in the described manner to insure essentially exact relative positioning of the hook 54 and the needle 28 to best avoid missed stitches, broken needles and other problems associated with conventional zig-zag sewing and thereby enables the sewing machine to realize optimal performance not herefore possible.

Figure 5:
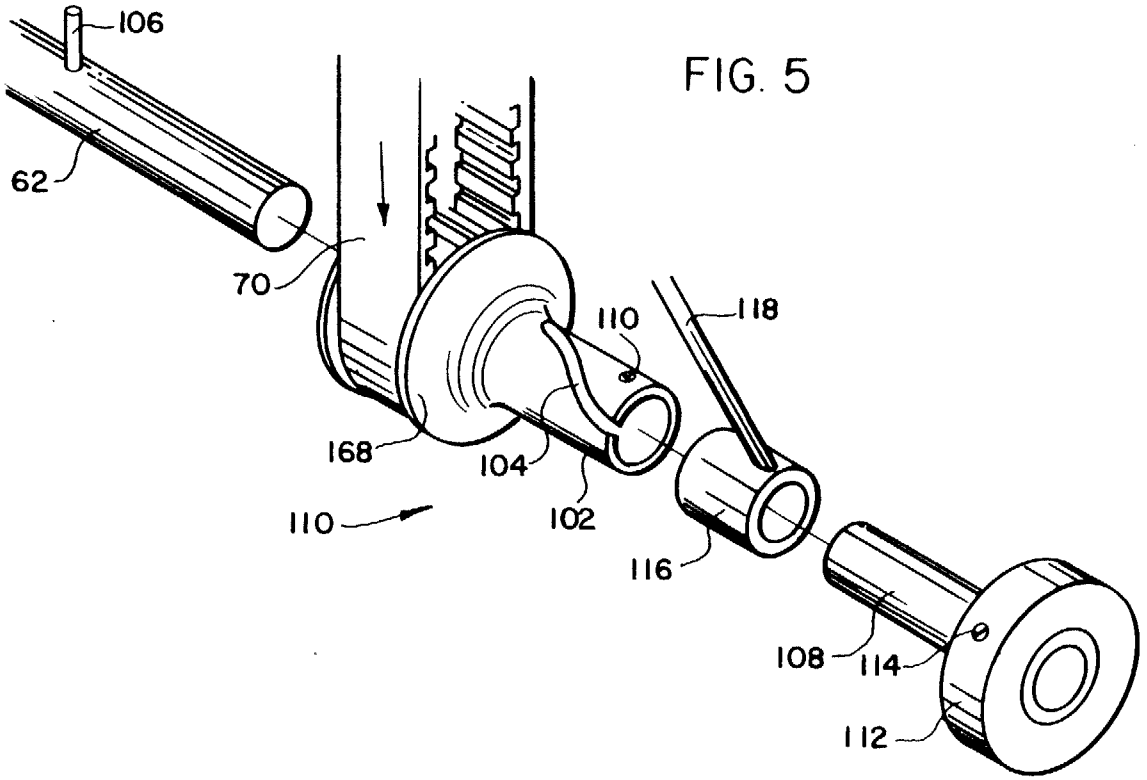
FIG. 5 is another exploded perspective view, similar to FIG. 2, of a second preferred embodiment of the present hook timing arrangement.

Referring now to FIG. 5, an alternate embodiment of the hook timing arrangement of the present invention is shown generally at 110. Basically, other than the individual components of the hook timing arrangement 110, the construction of the remainder of the sewing machine 12 is identical to that previously described and, accordingly, other than the drive belt 70 and the secondary drive shaft 62, only the components of the hook timing arrangement 110 are shown in FIG. 5. The hook timing arrangement 110 includes a drive pulley 168 rotatably supported on the secondary drive shaft 62 with the drive belt 70 trained peripherally about the pulley 168. Essentially, the drive pulley 168 is identical to the drive pulley 68 of the embodiment of FIGS. 1–2, except that, instead of the bevel gear 72, a tubular sleeve extension 102 projects coaxially from one side face of the pulley 168. A cam slot 104 is formed radially through the sleeve extension 102 to extend spirally along its axial length and partially about its circumferential extent. A drive pin 106 is fixed radially to the periphery of the secondary drive shaft 62 and extends outwardly through the cam slot 104. A bearing sleeve 108 is rotatably supported about the rightward end portio nof the secondary drive sahft 62, the rightwardmost end of the sleeve extension 102 coaxially receiving the bearing sleeve 108 and being fixed thereto by a set screw 110. A flange disk 112 is affixed to the opposite end of the bearing sleeve 108 by another set screw 114 and a bushing 116 is rotatably supported about the bearing sleeve 108 to extend in endwise abutment between the sleeve extension 102 and the flange disk 112. A drive link 118 extends between, and is connected at its opposite ends to, the needleshifting drive rod 50 (FIG. 1) and the bushing 116 for transmitting reciprocatory movement of the drive rod 50 synchronously to the bushing 116.

In operation, rotation of the drive pulley 168 by the drive belt 70 is transmitted by the sleeve extension 102 to the drive pin 106 to, in turn, drive rotation of the secondary drive shaft 62 in a counter-clockwise direction, as viewed in FIG. 5. At the same time, the bushing 116 is reciprocably driven axially with respect to the secondary drive shaft 62 by the drive rod 50, causing the sleeve extension 102 to corresponding reciprocate axially along the secondary drive shaft 62, and as a result the secondary drive shaft 62 is rotationally reciprocated by the cam action of the slot 104 on the drive pin 106. Specifically, as the drive rod 50 reciprocates leftwardly to shift the needle 28 into its leftward stitch position, the drive link, 118 correspondingly shifts the bearing sleeve 116 and, in turn, the sleeve extension 102 leftwardly along the secondary drive shaft 62, whereby the shaft 62 is moved in a counter-clockwise direction as the drive pin 106 follows the contour of the cam slot 104. As a result, the driven rotation of the looptaker 52 is accelerated slightly in relation to the driven speed at which it would be rotated without any rotational shifting of the secondary drive shaft 62, thereby advancing the hook 54 into an optimal loop-seizing disposition with respect to the needle 28 at its leftward stitch position (FIG. 4A). Similarly, upon rightward reciprocation of the drive rod 50 to shift the needle 28 into its rightward stitch position, the bushing 116 and the sleeve extension 102 are correspondingly shifted rightwardly by the drive link 118, causing the secondary drive shaft 62 to be reciprocated clockwise as the drive pin 106 follows the contour of the cam slot 104, thereby relatively decelerating the driven rotation of the looptaker 52 to retard its hook 54 to assume an optimal loop-seizing disposition with respect to the needle 28 at its rightwardly shifted stitch position. As will thus be understood, this embodiment provides the same operational advantages as the first embodiment of FIGS. 1 and 2, while being of a simplified construction using a minimal number of mechanical components. Proper material selection and machining of the sleeve extension 102 and the drive pin 106 are important in this embodiment to avoid undue and premature wear of such components.

Figure 6:
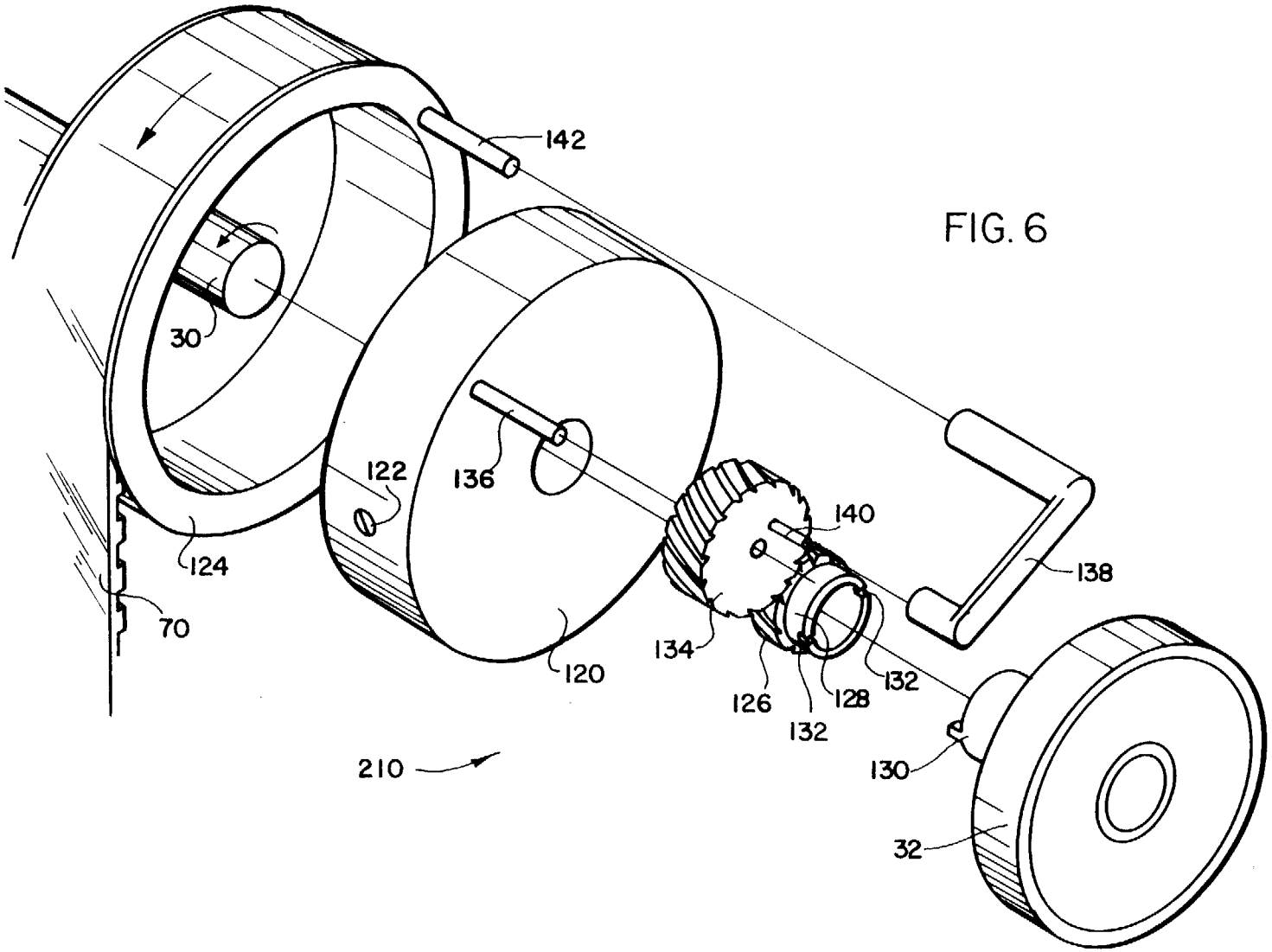
FIG. 6 is another exploded perspective view showing a third preferred embodiment of the hook timing arrangement of the present invention.

A third embodiment of the hook timing arrangement of the present invention is shown generally at 210 in FIG. 6, wherein the hook timing arrangement 210 is arranged in association with the main drive shaft 30 to eliminate the need for any connecting drive link with the needle-shifting drive rod 50. In this embodiment, a circular bearing hub 120 is fixed by a set screw 122 to the main drive shaft 30 of the sewing machine and an annular drive pulley 124 is rotatably supported about the hub 120. The drive pulley 124 is of essentially the same outer diameter and circumference as the drive pulley 66 utilized in a conventional sewing machine 12 and carries the drive belt 70 peripherally thereabout for driving of a speed-change drive pulley (not shown) which, in this embodiment, is fixed in conventional fashion to the secondary drive shaft 62, thereby to achieve a proper speed increase from the main drive shaft 30 to the secondary drive shaft 62 as above-described. A spiral sun gear 126 is fixed to a busing 128 rotatably supported coaxially about the main drive shaft 30. A key 130 is mounted to a supporting bearing 32 for the main drive shaft 30 and mates with slots 132 in the bushing 128 to hold the sun gear 126 stationary against rotation. A spiral planetary gear 134 is rotatably mounted on a supporting pin 136 which projects eccentrically from the hub 120, for meshing engagement between the sun and planetary gears 126, 134. The sun and planetary gears 126, 134 are selected of relative sizes such that the planetary gear 134 will complete one-half of a revolution, i.e. 180° rotation, for each complete 360° orbit about the sun gear 126. On eend of a drive link 138 is connected eccentrically to the planetary gear 134 by a drive pin 140 projecting axially from the planetary gear 134 and the opposite end of the drive link 138 is similarly connected to the drive pulley 124 by another drive pin 142 projecting axially from the drive pulley 124.

Figure 7A:
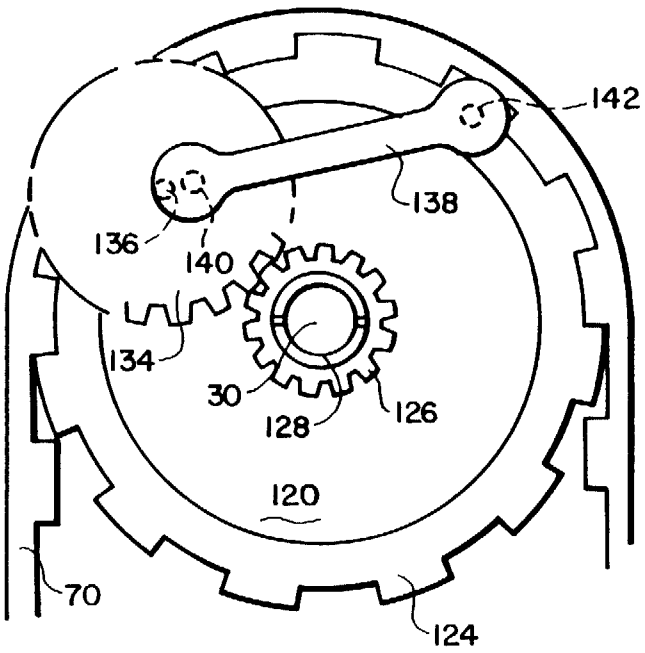
FIGS. 7A and 7B are end elevational views of the hook timing arrangement of FIG. 6 as disposed when the needle is at its leftward and rightward loop-forming positions.
Figure 7B:
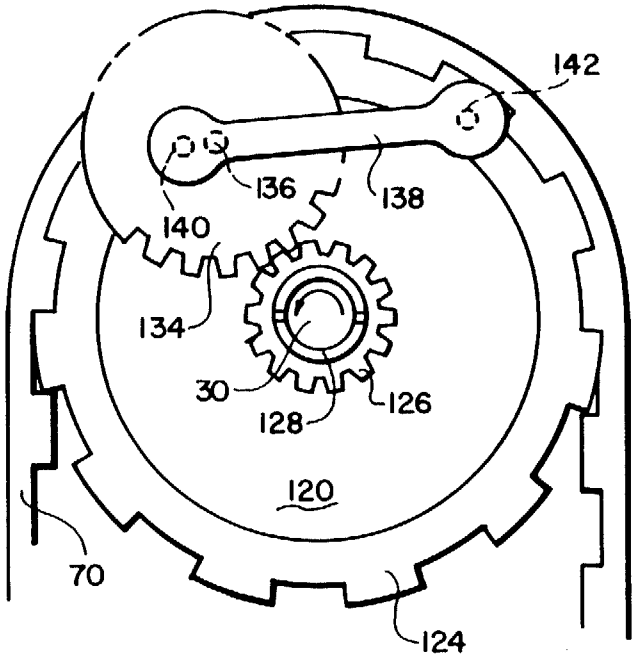

The operation of the embodiment of FIG. 6 may thus be understood. The hub 120 is rotated integrally with the main drive shaft 30 and, in turn, carries the planetary gear 134 orbitally about the stationary sun gear 126. The orbital motion of the planetary gear 134 is transmitted by the drive link 138 to drive rotation of the drive pulley 124 about the hub 120 and, in turn, to drive the secondary drive shaft 62 via the drive belt 70. Since the planetary gear 134 completes a one-half revolution for each full orbit about the sun gear 126, the drive pins 140, 142 are brought into alignment with the axis of the planetary gear 134 during each revolution of the hub 120 (i.e. during each orbit of the planetary gear 134), the drive pin 140 moving through an aligned position between the planetary gear axis 134 and the drive pin 142 during every alternate planetary gear orbit and moving through an aligned position opposite the planetary gear axis from the drive pin 142 during each intervening orbit, as shown in FIGS. 7A and 7B, respectively. The hook timing arrangement 210 is set up on the main drive shaft 30 such that the relative disposition of the components shown in FIG. 7A occurs upon each alternate revolution of the main drive shaft 30 producing a rightward reciprocation of the drive rod 50 to shift the needle 28 into its rightward stitch position and such that the relative disposition of the components shown in FIG. 7B occurs upon each intervening revolution of the main drive shaft 30 producing a leftward reciprocation of the drive rod 50 to shift the needle 28 into its leftward stitch position. Thus, when the needle 18 is shifted into its rightward stitch position, the hook timing arrangement 210 synchronously produces a relative deceleration in the driven rotational speed transmitted to the drive pulley 124 to, in turn, correspondingly decelerate the secondary drive shaft 62 and the looptaker 52, thereby retarding the rotation of the hook 54 to assume the optimal loop-seizing disposition relative to the needle 28 as shown in FIG. 4B. Likewise, when the needle 28 is shifted into its leftward stitch position, the hook timing arrangement 210 synchronously produces a relative acceleration of the driven rotational speed of the drive pulley 124 to, in turn, correspondingly accelerate the secondary drive shaft 62 and the looptaker 52, thereby advancing the hook 54 into the optimal loop-seizing disposition relative to the needle 28 as shown in FIG. 4A. Thus, this embodiment of the present hook timing arrangement provides the same advantages as the above-described embodiments, without requiring a drive link to the needle-shifting drive rod 50.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a sewing machine of the type adapted for forming stitches in a zig-zag pattern, said sewing machine having a thread-carrying needle, needle manipulating means for reciprocating said needle longitudinally to form thread loops and for shifting said needle laterally between spaced first and second loop-forming positions to distribute the thread loops in a zig-zag pattern, a looptaker rotatable about a fixed axis and having a hook for cooperating with said needle to seize the thread loops, and means for rotating said looptaker, the improvement comprising means coupling said looptaker rotating means to said needle manipulating means for alternately accelerating and decelerating rotation of said looptaker in timed relation to lateral shifting movement of said needle between its first and second loop-forming positions to advance said hook of said looptaker into a first loop-seizing disposition in relation to said needle at its said first loop-forming position and to retard said hook of said looptaker into a second loop-seizing disposition in relation to said needle at its said second loop-forming position.

2. The improvement in a zig-zag sewing machine according to claim 1 and characterized further in that said coupling means comprises a first drive member in driven relationship with said needle manipulating means, a second drive member in driving relationship with said looptaker rotating means, said second drive member being arranged in driven relationship to said first drive member, and transmission means for reciprocal shifting movement of said first and second drive members with respect to one another in synchronism with lateral shifting of said needle for varying drive transmission from said second drive member to said looptaker rotating means.

3. The improvement in a zig-zag sewing machine according to claim 2 and characterized further in that said needle manipulating means comprises means for laterally shifting said needle between its said first and second loop-forming positions, said transmission means comprising means for transmitting shifting movement of said needle shifting means to said second drive member.

4. The improvement in a zig-zag sewing machine according to claim 3 and characterized further in that said needle shifting means comprises a reciprocable rod connected with said needle for laterally reciprocating said needle, said transmission means comprising means for connecting said reciprocable rod with said second drive member for reciprocal shifting movement of said second drive member synchronously with said reciprocable rod.

5. The improvement in a zig-zag sewing machine according to claim 4 and characterized further in that said looptaker rotating means comprises a rotatable drive shaft, said first drive member being rotatable with respect to said shaft, said second drive member being fixed with respect to said shaft, said connecting means being arranged for rotationally reciprocating said second drive member and said shaft with respect to said first drive member.

6. The improvement in a zig-zag sewing machine according to claim 5 and characterized further in that said connecting means comprises a drive link connected to said reciprocable rod.

7. The improvement in a zig-zag sewing machine according to claim 6 and characterized further in that said first drive member comprises a driving bevel gear, said second drive member comprises a driven bevel gear meshing with said driving bevel gear, and said connecting means comprises gear means associated with said driven bevel gear and said driven link for shifting the relative meshing disposition of said driven bevel gear with respect to said driving bevel gear.

8. The improvement in a zig-zag sewing machine according to claim 6 and characterized further in that said first drive member comprises a driving pulley, said second drive member comprises a drive pin fixed to said shaft, and said connecting means comprises cam means fixed to said driving pulley and associated with said drive pin for shifting the relative rotational disposition of said shaft with respect to said driving pulley and said cam means.

9. The improvement in a zig-zag sewing machine according to claim 2 and characterized further in that said needle manipulating means comprises a main rotatable drive shaft, said first drive member being fixed with respect to said main shaft, said second drive member being rotatable with respect to said shaft, said transmission means being arranged for connecting said first and second drive members for rotationally reciprocating said second drive member with respect to said main shaft and said first drive member.

10. The improvement in a zig-zag sewing machine according to claim 9 and characterized further in that said second drive member is disposed coaxially about said first drive member, and said transmission means comprises a planetary gear arranged to orbit about the axis of said main shaft and to rotate within its orbit in timed relation to lateral shifting movement of said needle and a connecting link connected eccentrically to said planetary gear and connected to said second member for shifting the relative rotational disposition of said second drive member with respect to said main shaft and said first drive member.

11. The improvement in a zig-zag sewing machine according to claim 2 and characterized further in that said transmission means is arranged for shifting said second drive member with respect to said first drive member.

12. The improvement in a zig-zag sewing machine according to claim 11 and characterized further in that said needle manipulating means comprises main drive shaft, said looptaker rotating means comprises a secondary drive shaft, said coupling means comprising drive means for transmitting motion of said main drive shaft to said secondary drive shaft, said rive means comprising said first and second drive members.

* * * * *

UNITED STATES PATENT AND TRADEMARK OFFICE

CERTIFICATE OF CORRECTION

PATENT NO. : 4,924,788

DATED : May 15, 1990

INVENTOR(S) : Jerry D. Brown

It is certified that error appears in the above-identified patent and that said Letters Patent is hereby corrected as shown below:

Column 1, Line 20, reads "in the" but should read -- of the --.

Column 2, Line 20, reads "above-describe" but should read -- above-described --.

Column 2, Line 26, after "machine" add -- having --.

Column 2, Line 36, after "looptaker" add -- rotating --.

Column 2, Line 42, after "forming" delete -- forming --.

Column 3, Line 15, after "driven" add -- bevel --.

Column 3, Line 61, reads "are" but should read -- as --.

Column 4, Line 49, reads "manually" but should read -- manual --.

Column 4, Line 66, before "drive shaft 30" add -- main --.

Column 5, Line 21, reads "driven" but should read -- drive --.

Column 5, Line 22, reads "rotation" but should read -- rotational --.

Column 5, Line 30, reads "later" but should read -- lateral --.

Column 5, Line 31, reads "needle 238" but should read -- needle 28 --.

Column 5, Line 53, reads "at" but should read -- as --.

Column 5, Line 53, reads "counterclockwise" but should read -- counter-clockwise --.

UNITED STATES PATENT AND TRADEMARK OFFICE

CERTIFICATE OF CORRECTION

PATENT NO. : 4,924,788

DATED : May 15, 1990

INVENTOR(S) : Jerry D. Brown

It is certified that error appears in the above-identified patent and that said Letters Patent is hereby corrected as shown below:

Column 5, Line 65, reads "reciprocating" but should read -- reciprocation --.

Column 5, Line 66, reads "its" but should read -- it --.

Column 5, Line 67, reads "FIG." but should read -- FIGS. --.

Column 6, Line 45, reads "five" but should read -- fix --.

Column 6, Line 53, reads "mounting" but should read -- mounted --.

Column 7, Line 12, after "in" delete -- in --.

Column 7, Line 40, reads "product" but should read -- produce --.

Column 8, Line 22, reads "portio nof" but should read -- portion of --.

Column 8, Line 22, reads "sahft" but should read -- shaft --.

Column 8, Line 31, reads "needleshifting" but should read -- needle-shifting --.

Column 8, Line 42, reads "corresponding" but should read -- correspondingly --.

Column 8, Line 48, after "link" delete -- , --.

Column 9, Line 27, reads "busing" but should read -- bushing --.

Column 9, Line 39, reads "On eend" but should read -- One end --.

UNITED STATES PATENT AND TRADEMARK OFFICE

CERTIFICATE OF CORRECTION

PATENT NO. : 4,924,788

DATED : May 15, 1990

INVENTOR(S) : Jerry D. Brown

It is certified that error appears in the above-identified patent and that said Letters Patent is hereby corrected as shown below:

Column 12, Line 2, reads "driven link" but should read -- drive link --.

Column 12, Line 33, after "second" add -- drive --.

Column 12, Line 44, after "comprises" add -- a --.

Column 12, Line 48, reads "rive" but should read -- drive --.

Signed and Sealed this

Fifteenth Day of December, 1992

*Attest:*

DOUGLAS B. COMER

*Attesting Officer*

*Acting Commissioner of Patents and Trademarks*